US006609306B2

(12) United States Patent
Johnson et al.

(10) Patent No.: US 6,609,306 B2
(45) Date of Patent: Aug. 26, 2003

(54) BOW SIGHT

(76) Inventors: Jesse H. Johnson, 6358 Greensburg, Buffalo, KY (US) 42716; Michael D. Brangers, 245 B-Knob Rd., Ekron, KY (US) 40117

( * ) Notice: Subject to any disclaimer, the term of this patent is extended or adjusted under 35 U.S.C. 154(b) by 0 days.

(21) Appl. No.: 09/961,032

(22) Filed: Sep. 21, 2001

(65) Prior Publication Data

US 2003/0056379 A1 Mar. 27, 2003

(51) Int. Cl.[7] ..... F41G 1/467
(52) U.S. Cl. ..... 33/265; 124/87
(58) Field of Search ..... 33/265, 292, 286, 33/290; 124/87

(56) References Cited

U.S. PATENT DOCUMENTS

| | | | | | |
|---|---|---|---|---|---|
| 4,142,298 | A | * | 3/1979 | Killian | 33/265 |
| 4,220,983 | A | | 9/1980 | Schroeder | |
| 4,541,179 | A | * | 9/1985 | Closson | 33/265 |
| 4,553,338 | A | | 11/1985 | LeBeau | |
| 4,638,565 | A | | 1/1987 | Podany et al. | |
| 4,977,677 | A | | 12/1990 | Troescher, Jr. | |
| 5,072,716 | A | * | 12/1991 | Sappington | 124/87 |
| 5,092,052 | A | | 3/1992 | Godsey | |
| 5,152,068 | A | | 10/1992 | Meister et al. | |
| 5,201,123 | A | | 4/1993 | Booe | |
| 5,414,936 | A | * | 5/1995 | Sappington | 33/265 |
| 5,507,272 | A | * | 4/1996 | Scantlen | 124/87 |
| 5,644,849 | A | | 7/1997 | Slates | |
| 5,657,740 | A | * | 8/1997 | Slates et al. | 33/265 |
| 5,671,724 | A | | 9/1997 | Priebe | |
| 5,791,060 | A | | 8/1998 | Godsey | |
| 5,946,812 | A | * | 9/1999 | Slates | 33/265 |
| 6,016,608 | A | | 1/2000 | Lorocco | |
| 6,026,799 | A | | 2/2000 | Wiseby et al. | |
| 6,397,482 | B1 | * | 6/2002 | Chipman | 33/265 |
| 6,401,347 | B1 | * | 6/2002 | Slates | 33/263 |

OTHER PUBLICATIONS

U.S. Pat. No. 6,026,799 by Wiseby et al., for a "Device for a Sight" issued in Feb. of 2000.

U.S. Pat. No. 5,644,849 by Slates for a "Bow Sight Mount for Absorbing the Forces of Shear" issued in Jul. of 1997.

U.S. Pat. No. 5,152,068 by Meister et al., for an "Aiming Device for Archery" issued in Oct. of 1992.

U.S. Pat. No. 4,553,338 by LeBeau for an "archery Bow Adjustable Scope Mount" issued in Nov. of 1985.

U.S. Pat. No. 6,016,608 by Lorocco for a "sighting devices for Projectile Type Weapons" issued in Jan. of 2000.

U.S. Pat. No. 4,200,983 by Schroder for an "Illuminated Besought" issued in Sep. of 1980; and.

U.S. Pat. No. 4,977,677 by Troescher, jr. for a Targeting device issued in Dec. of 1990.

U.S. Pat. No. 4,638,565 by Podany et al. for a "Bow Sight" issued in Jan. of 1987.

U.S. Pat. No. 5,092,052 by Godsey for an "Adjustable Bow Sight" issued in Mar. of 1992.

U.S. Pat. No. 5,791,060 by Godsey for "Sighting Device for an Archery Bow" issued in Aug. of 1998.

U.S. Pat. No. 5,671,724 by Priebe for a "Bow Sight" issued in Sep. of 1997; and.

U.S. Pat. No. 5,201,123 by Booe for a "Bow Sighting Apparatus" issued in Apr. of 1993.

* cited by examiner

*Primary Examiner*—Diego Gutierrez
*Assistant Examiner*—Amanda J Hoolahan
(74) *Attorney, Agent, or Firm*—Carrithers Law Office; David W. Carrithers

(57) ABSTRACT

A simple light weight bow sight mounting apparatus which has a rigid frame slidably mountable on a bow frame for movement along a first linear path corresponding in direction generally to the archers line of sight. A threaded rod is mounted on the frame for rotation about the longitudinal axis of the rod and carries thereon a slide bock that is moved along a second linear path by rotating the threaded rod. A sight mounting block is mounted on the slide block for rotation about an axis parallel to the first linear path. A sight element is mountable on the slide block and adjustably movable along a third linear path. The first, second and third linear paths are mutually perpendicular.

23 Claims, 3 Drawing Sheets

BOW SIGHT

BACKGROUND OF THE INVENTION

1. Technical Field

This invention relates generally to archery and more particularly to a simple, light weight, variously adjustable bow sight mounting apparatus, a bow sight incorporating such apparatus and an archery bow having a sight mounted thereon by such mounting apparatus.

2. Background Information

Since their inception, archery bows have evolved from the simple bow and string arrangement to the current state-of-the-art modern compound bows which, through a series of pulley arrangements, should allow the archer to improve his accuracy because he is not required to maintain maximum pull on the string throughout the full draw.

Archers have long been investigating means of improving their accuracy of aim to take advantage of the modern compound bows and seeking an aiming device readily adjustable at full draw while maintaining proper tilt and eliminating twist. This is not an easily solved problem. Since, unlike firearms, greater corrections for elevation angle and windage must be made. Due to the reduced velocity, configuration, and weight of an arrow it tends to drop appreciably over relative short distances compared to a bullet.

Prior art devices having improved aiming devices range from a very simple single element pin sight mounted on the bow to more elaborate combinations of multi-pin arrangements, cross hairs, peep sights on the bow string, to trigger mechanisms attempting to raise and lower the aiming devices to specific horizontal planes. However, none of the conventional prior arts allow for a simple wrist and full draw adjustment that will eliminate the problems acquired in bow shooting, such as cant, tilt, twist and yardage adjustment as well as compensating for elevated shooting.

Initially, bows relied on the operators eye and judgement, which came with increasing experience, to aim the bow and determine the proper angle of elevation. Arrow velocities were relatively low and shooting distances were similarly short. Therefore, sophisticated aiming devices were not required. However, with the advent of the compound bow with its inherent ability to produce greater velocities, thus longer shooting distances, the need for improved aiming devices became evident.

Conventional sights range from a very simple single element pin sight mounted on the bow to more elaborate multi-pin arrangements. However, most of these devices require the archer to move his/her eye in relation to the sight, thus modifying their anchor point, which produces a different set of geometry. Causing the shooter to loose the consistency that insures accuracy.

Conventional sighting devices still leaves the shooter a great deal of self adjustment in regards to target change and, furthermore, he can make no changes especially at full draw. The true problem that exists with conventional sights is that in raising or lowering a bow to meet target changes of either greater or lessor yardage, the bow moves in an arch according to the anchor point of the archer. This movement is part of a segment of a circle. The degree or size of this circle is determined by the draw length of the archer. Thus determining the radius of movement of the bow and so determined by the archer standard anchor point. Prior art devices are mounted to bows vertically and travel with the bow in perpendicular manner throughout the radius of the arch. The archer must then change the sighting aperture to a pre-adjusted aperture to meet the intended target, thus moving the eye or anchor point. Conventional sights do not, in their design, compensate for all problems encountered in shooting a bow accurately, such as compensating for radial movement, bow twist, canting, and tilt.

Because of the pull or draw on the bow string to a standard anchor point and the projecting aperture being held in the hand, and the elasticity and movability of all, the problems of canting, tilt and twisting all become major concerns in accuracy to the intended target. Conventional sight devices do not solve this problem with a single unit.

Various bow sights are known and those disclosed in U.S. Pat. No. 5,092,052 granted Mar. 3, 1992 to Samuel W. Godsey and U.S. Pat. No. 6,026,799 granted Feb. 22, 2000 to Dennis Wiesby et al. are, to applicant's knowledge, the most closely related to the present invention. These references disclose a sight element attached to a base member that is movable vertically along a linear path in a direction perpendicular to an elongate mounting arm that attaches to the bow by a base plate.

The '052 reference teaches a lever being pivotally attached, intermediate its ends, to the mounting arm and it is connected at one end thereof to the base member by a sliding pivot. Pivoting the lever arm causes the base member to move upwardly, or downwardly, as desired, along the above mentioned linear path to change the sight line relative to the bow and thereby permitting the user to make adjustments for targets that are located at various different distances. The free end of the lever carries a locking screw that travels in an arcuate slot in an enlargement that is transverse to the length of the elongate arm. The sight element can be adjustably moved toward and away from the base member as well as along a path parallel to the above mentioned linear path. The 799 patent teaches a threaded screw is used to move the sight element up or down as desired and the mounting arm has a joint for articulated movement about a vertical axis.

While the forgoing devices are variously adjustable they are complicated and made of many components and thus expensive to produce.

SUMMARY OF INVENTION

A principal object of the present invention is to provide a bow sight mounting apparatus that is simple, sturdy, light in weight and variously adjustable.

A further principal object of the present invention is to provide an adjustable bow sight mounting apparatus that is easily adjusted and precise in adjustment.

The instant invention provides a bow sight mounting apparatus for mounting on a bow comprising a base plate for attachment to the bow, an elongate frame member. Included are means for mounting the frame member on the base plate for movement along a first linear path. Means for releasably locking the frame member on the base plate is also provided together with a threaded rod, and means for mounting the threaded rod on the frame member for rotation about the longitudinal axis of the rod. The longitudinal axis is disposed at a selected angle to the first linear path. A slide block having a threaded hole therethrough and means for slidably mounting the slide block on the frame member are defined for guided movement along a second linear path parallel to the longitudinal axis of the threaded rod. The threaded rod extends through the threaded hole and in mating engagement therewith and finger engagable means is connected to the rod for rotating the same to move the slide block longitudinally along the second linear path. A sight mounting block and means for mounting the sight mounting block on the slide block for rotation about a first axis of rotation is disposed at a selected angle to the longitudinal axis of the threaded rod. Also included are means for mounting a sight element on the sight mounting block.

It is also an object of the present invention to provide a bow sight mounting apparatus as described above with a sight element mounted on the sight mounting block thereof.

Also provided in accordance with the present invention is an archery bow having a sight element mounted thereon by a sight mounting apparatus as described above.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
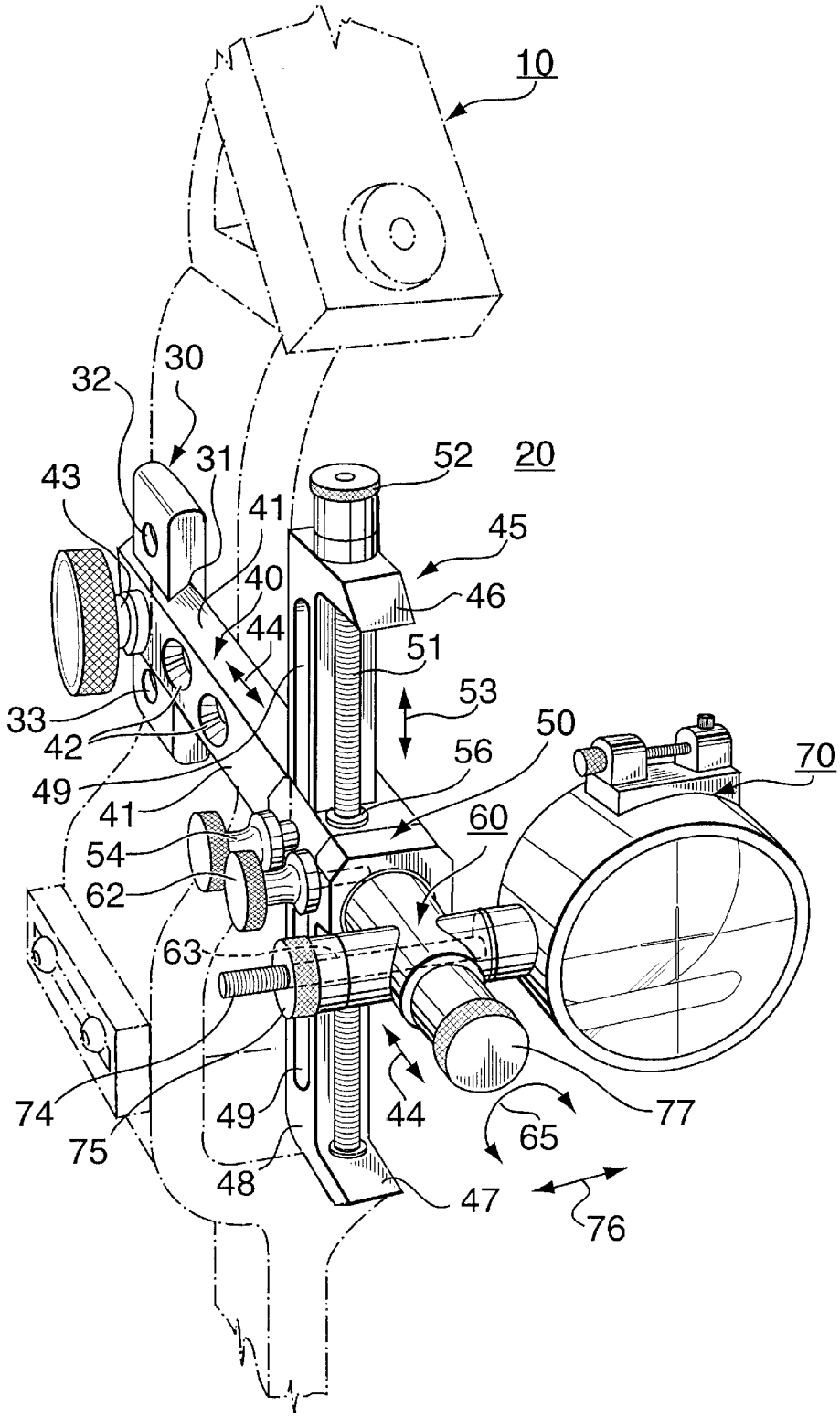
FIG. 1 is an oblique view of a portion of a bow with a bow sight mounted thereon by a mounting apparatus of the present invention and showing the bow in phantom lines.
Figure 2:
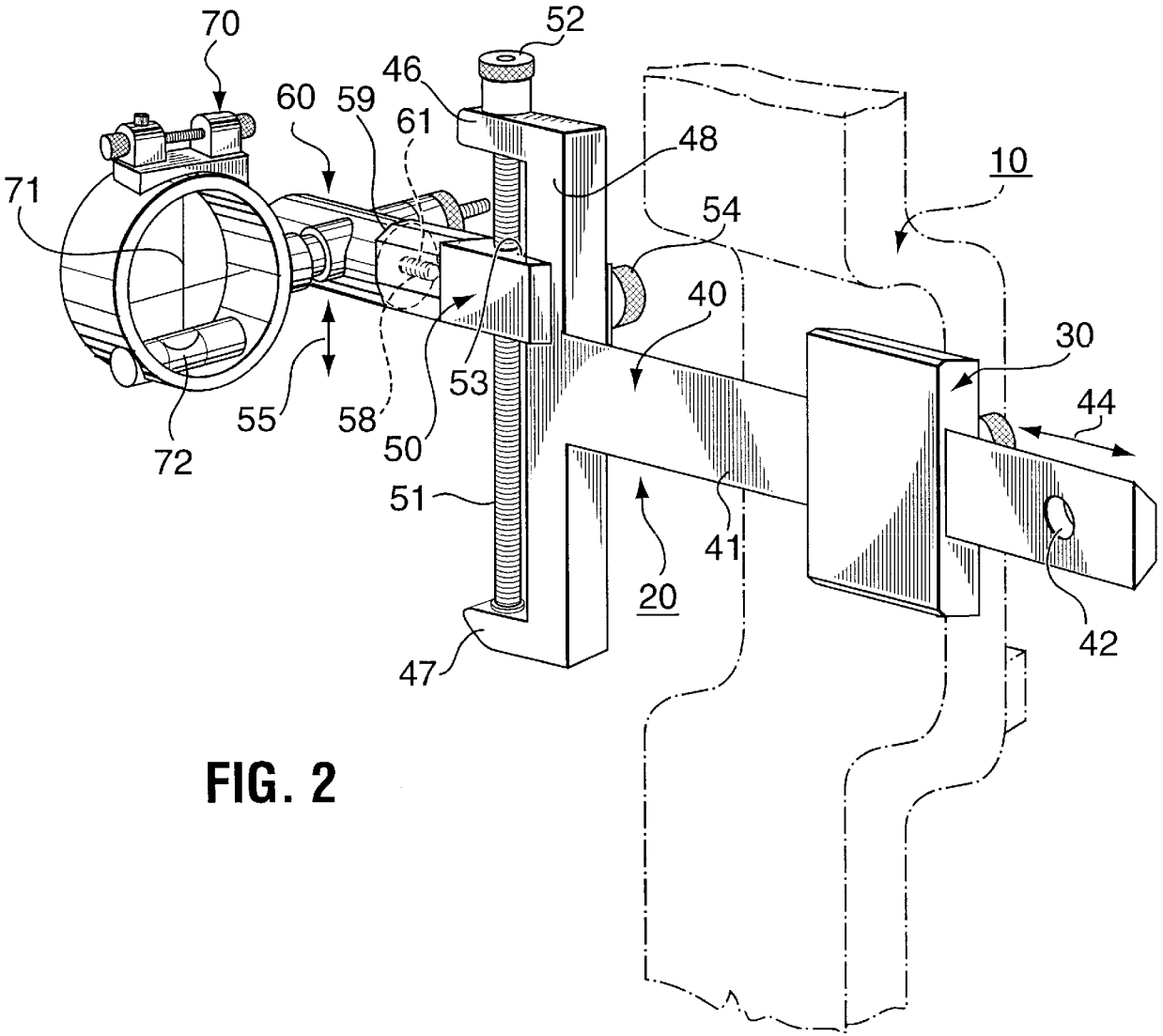
FIG. 2 is an oblique front view of the apparatus shown in FIG. 1 showing the bow in phantom lines.
Figure 3:
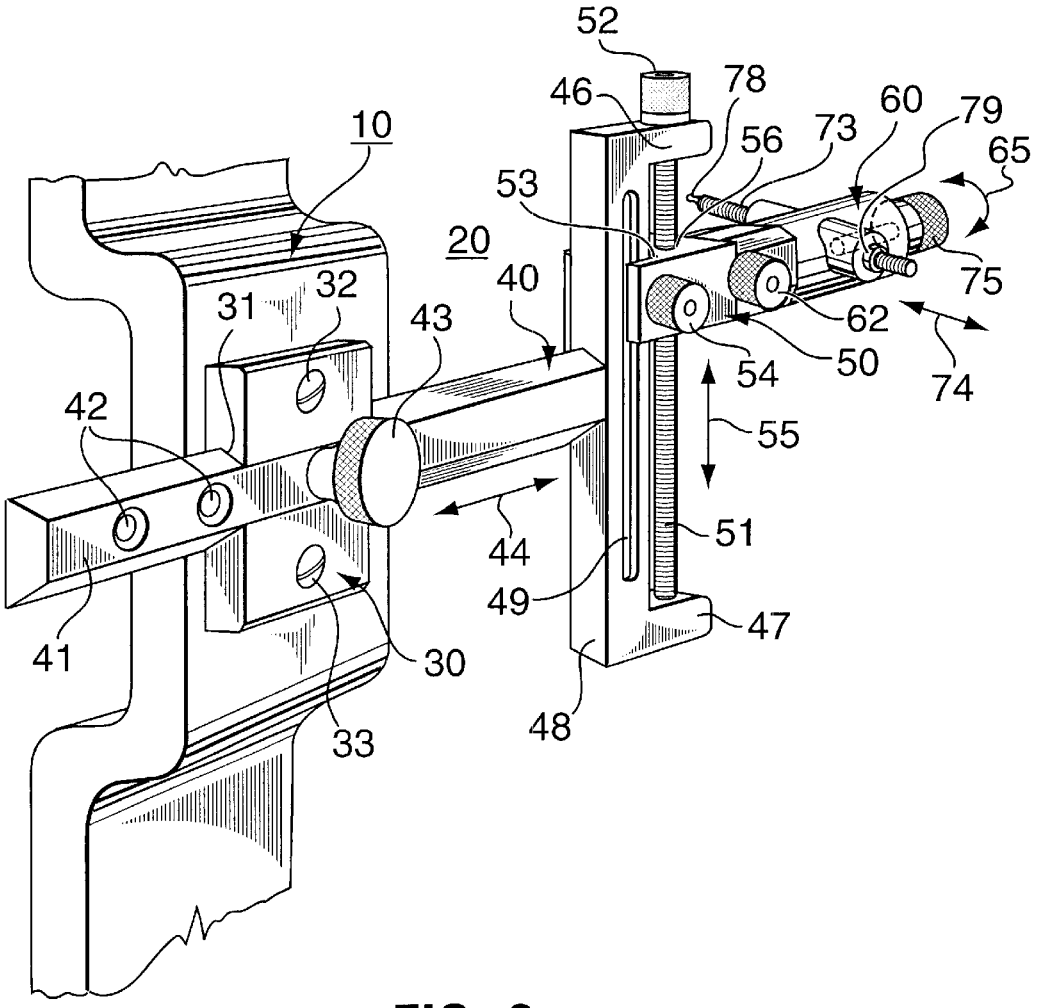
FIG. 3 is an oblique left side view of the invention shown in FIG. 1 illustrating a modified sight element.

Referring to the drawings, FIGS. 1–3, there is illustrated, in FIG. 1, a portion of an archery bow 10 with a sight apparatus 20 of the present invention mounted thereon. The sight apparatus 20 comprises a base plate 30 that mounts on the frame by two threaded fasteners, a rigid frame member 40 that is adjustably mounted on the base plate, a slide block 50 on the frame and movable by a threaded rod 51, a sight element mounting block 60 rotatably mounted on the slide block and a sight element 70 adjustably mounted on the mounting block. The sight element maybe any well known sight element having cross hairs 71 and a bubble level 72 as is shown in FIG. 1 or it maybe a simple pin or rod 73 as shown in FIG. 3. The sight mounting apparatus comprises the foregoing components less the sight element.

The base plate 30 has a dove-tail groove 31 slidably receiving therein, in mating relation therewith a stem portion 41 of the frame member 40. The stem 41 has three spaced apart threaded holes 42 for receiving a threaded stud 43 that has a finger engagable knurled knob. The stud 43 extends through the frame stem portion 41 to engage the bottom of the dove-tail groove to inhibit sliding of the frame relative to the base plate when so desired. The frame is thus adjustably mounted on the base plate and movable along a first linear path represented by the double headed arrow designated 44 extending generally in the direction of the sight line of the archer. The base plate has a spaced apart pair of holes for receiving respective ones of a pair of mounting studs 32, 33 that thread into suitably threaded holes or recesses in the bow.

The frame member 40 has a yoke at the forward end thereof defined by a spaced apart pair of lugs 46 and 47 and an elongate stem portion 48 disposed perpendicular to the above mentioned first linear path 44. There is a groove 49 in a side face of the frame stem portion 48 the purpose of which will become more apparent hereinafter. The threaded rod 51 is journalled for rotation about its longitudinal axis on the lugs 46, 47 and has a finger engagable knob 52 connected to one end thereof for rotating the rod. A similar knob (not shown) can, if desired, be connected to the opposite end of the threaded rod.

The slide block 50 has a groove 53 that slidably receives therein an edge portion of the yoke stem 48. A threaded stud 54 on the slide block projects into the groove 49 to retain the slide block on the frame member and guide the same along a second linear path represented by the double headed arrow designated 55. This second linear path 55 is in a direction perpendicular to the first linear path 44. The slide block guide and retaining means maybe a lug (not shown) on the slide block that projects into the groove 49 and/or the stud 54 that is threaded into a threaded hole in the slide block and projects into the groove 49. A knurled knob facilitates turning the stud 54 to selectively lock the slide block in position and allow the same to move along the linear path 55. The slide block has a threaded through hole 56 receiving therein the threaded rod 51 and rotation of this rod adjustably moves the slide block along the linear path 55.

The sight element mounting block 60 has a stem 61 as best shown in FIG. 2, extending therefrom that projects into a recess 58 in a free outer end 59 of the slide block 50. The stem 61 maybe a smooth pin or alternatively and preferably a threaded stud which threads into mating threads in the recess 58. The block 60 can be rotated 360 degrees about the axis of the stem 61 as represented by the double headed arrow 65 and locked in any desired position by a thumb screw 62 that has a terminal end engageable with the stem 61.

The sight mounting block 60 has a bore 63, transverse to the linear path 44, for receiving a threaded stem 74 on the sight element 70 as illustrated in FIGS. 1 and 2, or the sight element 73 illustrated in FIG. 3. The sight element 70 can be adjustably moved along a linear path indicated by a double headed arrow designated 76 by a threaded adjusting nut 75 and locked at any desired position by a thumb set screw 77. The sight element 73 has a sighting tip 78 and is adjustably movable by a pair of threaded nuts 79 located respectively on opposite sides of the sight mounting block 60.

The linear paths 44, 53 and 76 are perpendicular to one another providing three dimensional adjustment and the arcuate path 65 represents rotational movement of the sight element about an axis parallel to the linear path 44.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A bow sight mounting apparatus for mounting on a bow comprising:

a base plate for attachment to the bow;

a frame member;

means for mounting said frame member on said base plate for movement along a first linear path that corresponds in direction generally to a sight line of an archer;

means releasably locking said frame member on said base plate;

a threaded rod;

means for mounting said threaded rod on said frame member for rotation about a longitudinal axis of said rod and with such axis disposed at a selected angle to said first linear path;

a slide block having a threaded hole therethrough;

means slidably mounting said slide block on said frame member for guided movement along a second linear path parallel to said longitudinal axis of said threaded rod, wherein said threaded rod extends through said threaded hole and in cooperative mating engagement therewith;

means connected to said rod for rotating the same to move said slide block longitudinally along said second linear path;

a sight mounting block;

means for mounting said sight mounting block on said slide block for rotation about a first axis of rotation disposed at a selected angle to said longitudinal axis of said threaded rod; and means for mounting a sight element on said sight mounting block.

2. The bow sight mounting apparatus as defined in claim 1, wherein said sight element is adjustably movable along a third linear path and wherein said first, second, and third linear paths are mutually perpendicular.

3. The bow sight mounting apparatus as defined in claim 2, wherein said first axis of rotation is parallel to said first linear path.

4. The bow sight mounting apparatus as defined in claim 1, wherein said base plate has a dove-tail groove therein and wherein said frame has an elongate portion disposed in sliding mating relation in said groove.

5. A bow sight mounting as defined in claim 1, wherein said frame member is a rigid member having a first elongate portion disposed in sliding mating relation in said dove-tail groove in said base plate and a second elongate stem portion at one end of said first portion and at right angles thereto and a pair of lugs projecting from said second elongate stem portion, said lugs being spaced apart from one another longitudinally along said stem and means mounting said thread rod on said lugs for rotation about the longitudinal axis of the rod, said rod extending from one lug to the other and having said slide block mounted thereon.

6. The bow sight mounting apparatus as defined in claim 1, including a sight element and means adjustably mounting said sight element on said slide block.

7. The bow sight as defined in claim 6, wherein said sight element includes cross-hairs and a bubble level.

8. The bow sight as defined in claim 6, wherein said sight element comprises a threaded pin having a sighting tip on a free outer end thereof.

9. The bow sight as defined in claim 6, including a bow for mounting thereon.

10. The bow sight mounting apparatus for mounting on a bow comprising:

a base plate for attachment to the bow;

a frame member comprising a yoke at a forward end thereof defining a spaced apart pair of lugs, and an elongate portion;

means for adjustably mounting said frame member on said base plate for movement along a first linear path that corresponds in direction generally to sight line of an archer, said base plate including a dove-tail groove therein cooperatively engaging said elongate portion of sad frame being disposed in sliding mating relation with said dove tail groove of said base plate;

at least one threaded fastener releasably locking said frame member on said base plate;

a threaded rod extending between said spaced apart pair of lugs of said yoke;

a knob connecting to one end of said threaded rod for rotating said threaded rod about its longitudinal axis and with such axis disposed at a selected angle to said first linear path;

a slide block having a threaded hole therethrough;

said slide block including a groove for slidably receiving therein an edge portion of said yoke for slidably mounting said slide block on said frame member for guided movement along a second linear path parallel to said longitudinal axis of said threaded rod, wherein said threaded rod extends through said threaded hole and in cooperative mating engagement therewith;

a knob connecting o said rod for rotating the same to move said slide block longitudinally along said second linear path;

a sight mounting block; means for mounting said sight mounting block on said slide block for rotation about a first axis of rotation disposed at a selected angle to said longitudinal axis of said threaded rod comprising said sight mounting block including a stem extending therefrom projecting onto a recess of a free outer end of said slide block enabling rotation of said slide block 360 degrees about the axis of said stem; and means for mounting a sight element on said sight mounting block.

11. The bow sight of claim 10, wherein said slide block can be rotated 360 degrees and locked in any desired position by a thumb screw having a terminal end engageable with said stem.

12. The bow sight of claim 10, wherein said stem comprises a smooth pin.

13. The bow sight of claim 10, wherein said stem comprises a threaded stud threadably engaging said recess.

14. The bow sight of claim 10, wherein said slide block guide and retaining means comprises a lug on said slide block projecting into said groove.

15. The bow sight of claim 10, wherein said slide block guide and retaining means comprises a stud threadably engaging a threaded hole in said slide block and projects into said groove.

16. The bow sight of claim 15, wherein a knob facilitates turning said stud selectively locking said slide block in position and allowing same to move along said linear path.

17. The bow sight mounting apparatus as defined in claim 10, wherein said light element is adjustably movable along a third linear path and wherein said first, second, and third linear paths are mutually perpendicular.

18. The bow sight mounting apparatus as defined in claim 17, wherein said first axis of rotation is parallel to said first linear path.

19. A bow sight mounting as defined in claim 10, wherein said frame member is a rigid member having a first elongate portion disposed in sliding m ting relation in said dove-tail groove in said base plate and a second elongate stem portion formed integral therewith extending from one end of said first portion and at right angles thereto.

20. The bow sight mounting apparatus as defined in claim 10, including a light element and means adjustably mounting said sight element on aid slide block.

21. The bow sight as defined in claim 20, wherein said sight element includes cross-hairs and a bubble level.

22. The bow sight as defined in claim 20, wherein said sight element comprise a threaded pin having a sighting tip on a free outer end thereof.

23. The bow sight as defined in claim 10, including a bow for mounting thereon.

* * * * *